United States Patent [19]

Chesnut

[11] Patent Number: 4,586,281

[45] Date of Patent: May 6, 1986

[54] CARTRIDGE MAGAZINE FOR USE WITH A PLURALITY OF FIREARMS

[76] Inventor: M. Gaines Chesnut, 17219 W. 57th Pl., Golden, Colo. 80401

[21] Appl. No.: 709,769

[22] Filed: Mar. 8, 1985

[51] Int. Cl.[4] ..... F41C 25/00

[52] U.S. Cl. ..... 42/50

[58] Field of Search ..... 42/50, 18, 22

[56] References Cited

U.S. PATENT DOCUMENTS

| | | | |
|---|---|---|---|
| 3,732,643 | 5/1973 | Wells | 42/50 |
| 4,139,959 | 2/1979 | Howard et al. | 42/50 |
| 4,413,437 | 11/1983 | Anderson | 42/50 |

*Primary Examiner*—Charles T. Jordan

*Attorney, Agent, or Firm*—Sheridan, Ross & McIntosh

[57] ABSTRACT

A cartridge magazine for storing cartridges is provided that can be used with a plurality of styles of firearms, and particularly for use with the Colt M16/AR-15 and the Ruger Mini-14/AC 556 styles of firearms. The cartridge magazine includes a number of different latch-related elements for use in engaging different cartridge magazine latching mechanisms found on each of the styles of firearm. The width and thickness dimensions of the magazine are such that insertion into each of the firearms can be accomplished without binding. A magazine follower is also provided with different bolt hold open engaging elements on the same follower in order to accommodate the different styles of firearms. A stop member is included on the magazine to prevent excessive insertion of the magazine relative to one of the firearms. A positioning member located on the magazine assists alignment of the cartridges during loading thereof into the firearm so that jamming of the cartridges is eliminated. The magazine also has a spring attached to the follower in which portions of the spring define predetermined angular relationships to further facilitate receipt of a cartridge by the selected firearm.

20 Claims, 8 Drawing Figures

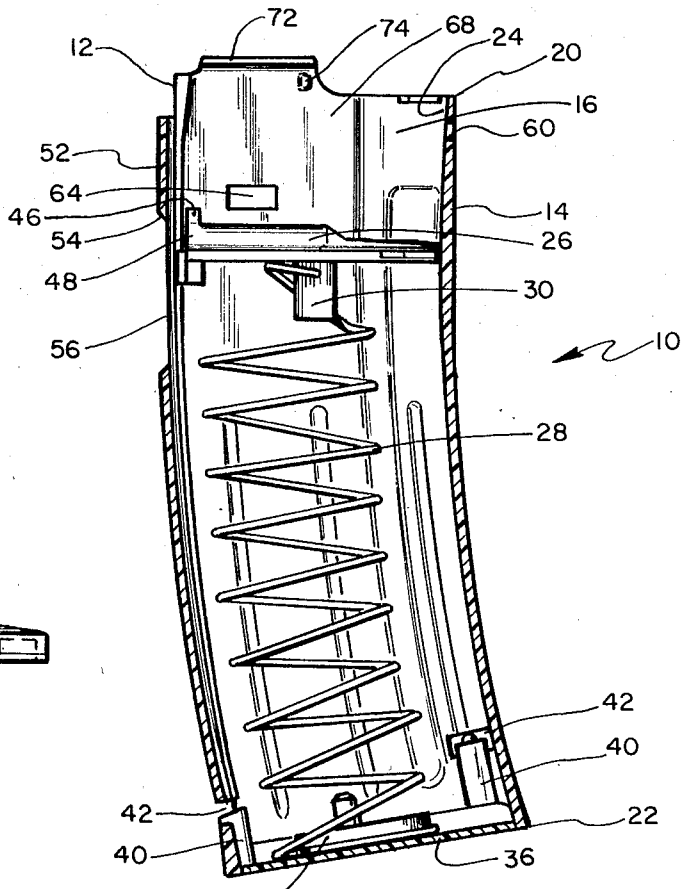
Fig. 6
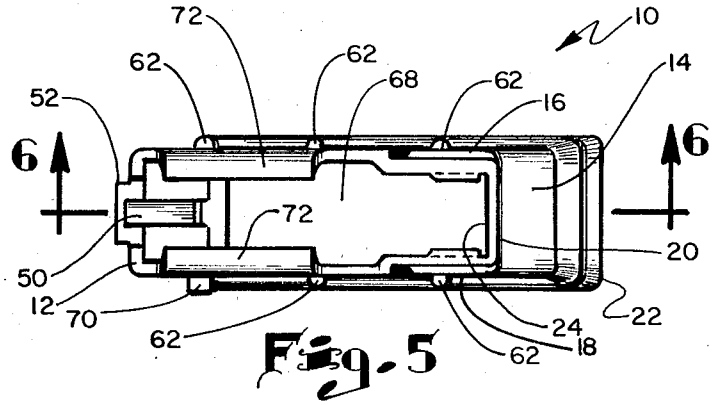
Fig. 5
Fig. 8
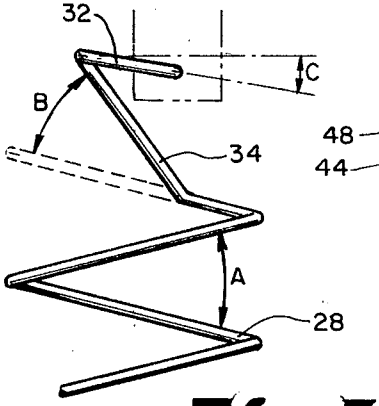
Fig. 7

CARTRIDGE MAGAZINE FOR USE WITH A PLURALITY OF FIREARMS

FIELD OF THE INVENTION

The present invention relates to a firearm cartridge magazine and, in particular, to a magazine adapted for use with a plurality of styles of firearms.

BACKGROUND INFORMATION

Many available firearms utilize a cartridge magazine for holding a number of cartridges to be received into the firearms. Prior magazine cartridges are configured such that each magazine can only be used with one type or style of firearm. As a result, a user of more than one firearm must keep on hand a number of different cartridge magazines. In addition to increasing the inventory of magazines, this lack of interchangeability results in an increased cost to the user because the user must buy more than one type of magazine for use with each different firearm. Also, the non-interchangeability factor can be a serious concern in the law enforcement area. Law enforcement officials commonly carry more than one firearm. When time is critical, such as occurs occasionally during the performance of the duties of a law enforcement official, there is a serious time disadvantage in having to be concerned about selecting the proper magazine for the chosen firearm.

This interchangeability problem relating to cartridge magazines is found in firearms known as the M16/AR-15, the AR-180, a firearm similar to the M16/AR-15, and the Ruger Mini-14/AC 556, as well as other styles of firearms. M16/AR-15 is a gun model designation of Colt Industries Operating Corp., located in Connecticut, Ruger Mini-14/AC 556 is a gun model designation of Sturm, Ruger & Company, Inc., located in Connecticut and AR-180 is a gun model designation of Armalite, Inc., located in California. Such conventional styles of cartridge magazines are non-interchangeable in the sense that a conventional cartridge magazine which is functional in the M16/AR-15 style of firearm cannot be used in the Ruger Mini-14/AC 556 style of firearm. Similarly, the conventional magazine used in the Ruger Mini 14/AC 556 style of firearm cannot be used in the M16/AR-15 style of firearm. It should be noted that this lack of interchangeability is not limited to just these two magazines but is prevalent among a great number of magazines. The non-interchangeability drawback associated with cartridge magazines exists because of a number of structural differences that are found on the various styles of firearms.

Cartridge magazines adapted for use with firearms typically include latching elements or parts that are used to engage latching mechanisms found on firearms. By way of example and with regard to each of the cartridge magazine latching mechanisms of the above-identified two styles of firearms, each such mechanism is different from the other style of firearm. In particular, the cartridge magazine latching mechanism used on the M16/AR-15 style of firearm is of such a nature that its cartridge magazine must have a slot on one of the walls of the magazine. The Ruger Mini-14/AC 556 style of firearm has a cartridge latching mechanism of such a nature that its cartridge magazine must have a ledge on a first narrow wall of the cartridge magazine and a slot on the second narrow wall of the magazine.

The straight-forward combination of the various latching parts into a single cartridge magazine cannot be achieved to produce a magazine which is adaptable for use with all three styles of firearms, for a number of reasons. First, a vertically extending projection found on one of the the M16/AR-15 magazine walls would not permit proper operation of the latching mechanism found on the Ruger Mini-14/AC 556 firearm. Secondly, the conventional Ruger Mini-14/AC 556 cartridge magazine has a width greater than the maximum width of a magazine which can be used with the M16/AR-15 firearm. Conversely, the conventional M16/AR-15 cartridge magazine has a thickness greater than the thickness of the conventional cartridge magazine which can be used with the Ruger Mini-14/AC 556 firearm. In addition, the M16/AR-15 conventional style of firearm includes a protrusion next to its latch-engaging slot. This protrusion prevents proper engagement by the Ruger Mini 14/AC 556 firearm with the conventional M16/AR-15 magazine. Also, the length of the member on the conventional magazine follower used to hold the bolt open on the M16/A-15 firearm is so great such that, if this magazine could be used with the magazine of a Ruger Mini 14/AC 556 style of firearm, this bolt hold open member would undesirably hit that surface in the firearm located below the bolt when the magazine is rotated to disengage the latching lever of the firearm from the magazine, after the last cartridge has been loaded.

Despite the foregoing incompatibilities among the cartridge magazines such styles of firearms, several advantages result from the development of an interchangeable cartridge magazine for use with different styles of firearms. In that regard, the present invention is directed to providing a cartridge magazine adapted for use with a plurality of styles of firearms, and particularly adapted for use with both the M16/AR-15 and Ruger Mini-14/AC 556 styles of firearms.

SUMMARY OF THE INVENTION

A cartridge magazine is disclosed which is adapted for use with a plurality of styles of firearms and, in particular, is adapted for use with the M16/AR-15 and the Ruger Mini-14/AC 556 styles of firearms. The cartridge magazine of the present invention includes a case comprised of a number of walls, the walls being defined as a front wall, a rear wall, and first and second side walls. The case has been devised of a predetermined width and thickness so that the magazine can be inserted into and held by the magazine well of more than one style of firearm. The front, first, and optionally, second side walls are provided with slots while a ledge is provided on the rear wall. The slots and ledge are used to operably engage magazine latching mechanisms of a plurality of firearms. Preferably, the magazine is of a size and the slots are so formed that the magazine can be used with both Ruger Mini-14/AC 556 and M16/AR-15 styles of firearms.

The rear wall of the cartridge magazine also has upper and lower ridges, with the lower ridge extending from the rear wall for a distance less than the upper ridge. The lower ridge is used in defining the ledge. The lower ridge allows for movement of a latch member found on the Ruger Mini-14/AC 556 style of firearm. The magazine cartridge further includes a stop member disposed on its exterior surface to limit the degree of insertion of the magazine into a firearm.

A follower is positioned within the walls of the case and is movably supported using a coiled spring attached thereto. The follower and coil spring combination are used in receiving and supporting the cartridges and for advancement of the cartridges individually into the firearm. The follower includes two bolt hold open actuating or engaging elements in which one is for use with a first style of firearm while the other is for use with a second style of firearm. Preferably, an end portion of the spring adjacent to the follower is at a predetermined angle or bent to provide desired nose up pressure on the last cartridge remaining in the magazine.

In the preferred embodiment of the invention, the first and second side walls of the cartridge magazine are extended some distance beyond an edge of the front wall and curve inwardly to form lips which partially overlay the opening at the top of the cartridge magazine. These first and second side wall extensions are provided with positioning members which serve to position or guide the nose end of each of the cartridges toward the centerline of the magazine in order to prevent jamming of the cartridges during operation of the firearm. These positioning members are particularly useful when the cartridge magazine is fashioned from a material, such as certain plastics, having a degree of resiliency.

In view of the foregoing description, a number of advantages of the present invention are readily discernible. A cartridge magazine is provided that can be used with more than one firearm. As a consequence, it is not always necessary to purchase a different magazine simply because a different firearm is to be used. Additionally, fewer different types of magazine cartridges need be available when different firearms might be utilized. Relatedly, fewer magazines need be stored or carried when the use of different firearms is anticipated. The preferred magazine is made of plastic, or other like material, so that the cost of manufacture of the present invention is reduced and the simplicity of manufacture is enhanced.

BRIEF DESCRIPTION OF THE DRAWINGS

FIG. 5 is a top plan view thereof;

FIG. 6 is a longitudinal cross-sectional view, taken along lines 6—6 of FIG. 5, showing the positioning member;

FIG. 7 is an enlarged elevational view of a portion of the coiled spring showing angular relationships between certain portions of the spring; and FIG. 8 is a side elevational view of the follower.

DETAILED DESCRIPTION OF THE PREFERRED EMBODIMENTS

Figure 1:
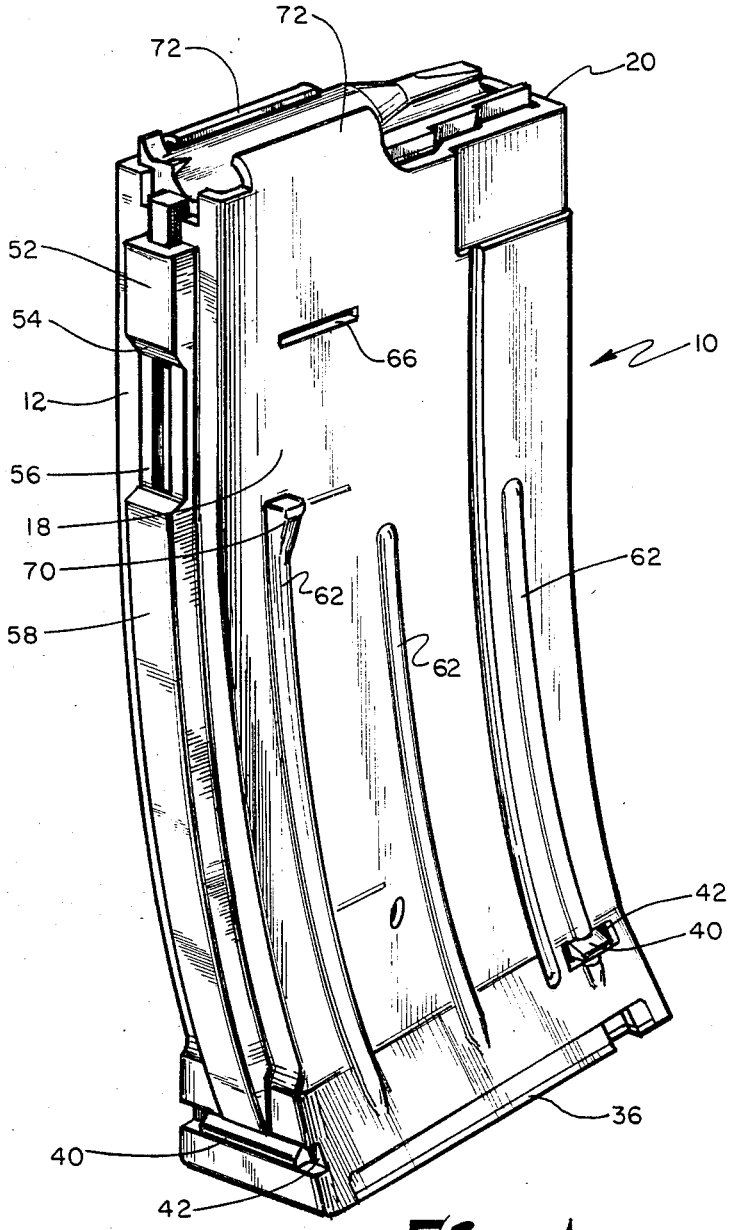
FIG. 1 is a perspective view of the cartridge magazine of the present invention.
Figure 4:
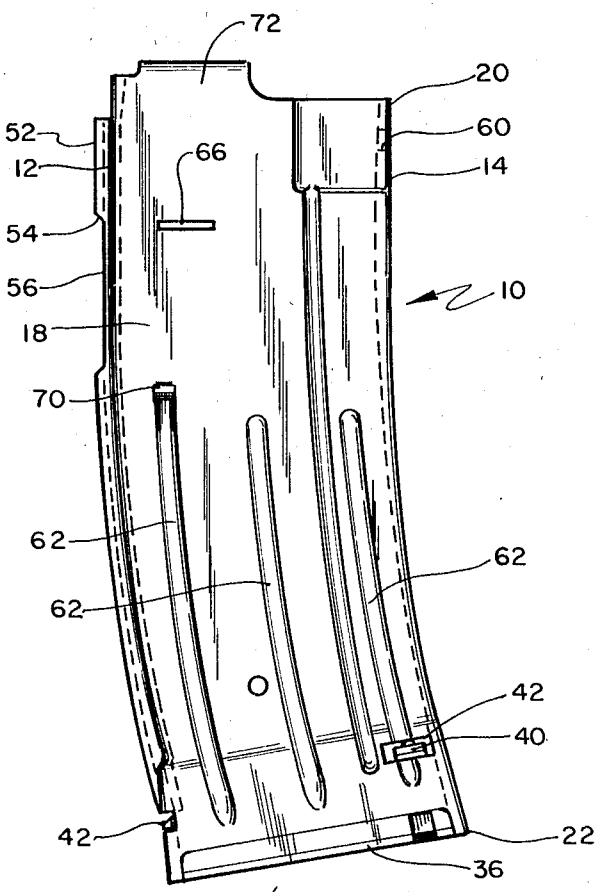
FIG. 4 is a second side elevational view thereof.

In accordance with the present invention, a cartridge magazine is provided which is adapted for use with a plurality of styles of firearms. Referring now to the drawings, FIG. 1 shows the cartridge magazine comprising a case 10. The case 10 comprises four walls, namely, a rear wall 12, a front wall 14, a first side wall 16, and a second side wall 18. The case 10 has an outside width, length and thickness. As used herein to refer to the outside dimensions of the case 10, the width is the distance between the exterior of the rear wall 12 and the exterior of the front wall 14. The thickness is the distance between the exterior of the first side wall 16 and the exterior of the second side wall 18. The front wall 14 has an upper edge 20 and a lower edge 22. The length of the case 10 is the distance between the front wall upper edge 20 and front wall lower edge 22, measured along the exterior surface of the front wall 14.

The interior surfaces of the four walls define a magazine chamber 24. Disposed within the chamber 24 is a follower 26 mounted for sliding movement relative to the longitudinal extent of the chamber 24. The follower 26 is adapted to contact and support the lowermost of the cartridges which are held in the magazine chamber 24. The cartridge magazine also has means for urging the follower 26 in a direction towards the top of the case 10. In the preferred embodiment of the invention, the means for urging the follower comprises a coiled-like spring 28. One end of the spring 28 is attached to the follower 26 by means of a stud 30 attached to and extending from the bottom of the follower 26 and preferably integral therewith. In the preferred embodiment, as shown in FIG. 7, the spring 28 includes an end portion 32 and a leg 34 integrally joined to the end portion 32. As can be seen, the leg 34 is bent at an angle such that the angle formed between the leg 34 and its immediately adjacent coil or leg is different from that angle formed between other adjacent legs of the spring. That is, the angle A formed between coils of the spring 28, other than the leg 34, is about 30° when the follower 26 is in the upmost position for delivery of the last remaining cartridge into the firearm, whereas the angle B, which includes the leg 34, is preferably about 40° when the follower 26 is in the upmost position. The increased angular relationship between the leg 34 and its adjacent coil (about 70°, 40°+30°) provides an enhanced force or pressure to keep the bolt hold open on the firearm for the last cartridge in the magazine. Additionally, the end portion 32 of the spring 28 forms a predetermined angle with the horizontal plane of the follower 26. This angle C is preferably in the range of 11°–13° when the follower 26 is in the upmost position and such an angle allows the follower 26 freedom to rotate with some force or pressure on the last cartridge in the magazine causing the nose of the cartridge to be pushed or forced up. This prevents unwanted jamming of the cartridge in the firearm.

The bottom of the case 10 in the preferred embodiment is covered by a floor plate 36. The other end of the spring 28 is seated in the floor plate 36, preferably in a floor plate spring seat 38. The floor plate 36 may be attached to the walls of the case 10 be a number of suitable fasteners well known in the art. Conveniently, the floor plate 36 is attached to the walls by one or more floor plate latches 40 which engage with latch receivers 42 formed in the case walls.

In the preferred embodiment, attached to or formed on the same follower 26 are first and second elements 44, 46 for engaging the bolt lock assembly of two different styles of firearms. The bolt lock assembly is used to indicate when there are no cartridges remaining in the firearm or magazine. In particular, the first bolt engaging element 44 is of such shape and position as to be capable of engaging or actuating the bolt lock or hold open assembly of a first style of firearm and the second bolt engaging element 46 is of such a shape and position as to be capable of engaging the bolt lock or hold open assembly of a second style of firearm. In the preferred embodiment, the first style of firearm is an M16/AR-15 style of firearm and the second style of firearm is the Ruger Mini-14/AC 556 style of firearm. The first bolt engaging element 44 comprises a projection extending outwardly from the rear edge 48 of the follower 26. This projection preferably extends outwardly only about 0.085 inches. This projection is less in length than the projection on the follower found in the conventional magazine used with the M16/AR-15 firearm, which length is about 0.11 inches. Because of this reduced length, the first bolt engaging element 44 does not strike the surface of the Ruger Mini-14/AC 556 firearm when the follower 26 moves upward as the last cartridge is being expended from the magazine. The second bolt engaging element 46 comprises a tooth projecting upwardly from the upper surface of the follower 26. Because the first bolt engaging element 44 attached to the follower 26 in the preferred embodiment extends outwardly from the rear edge 48 of the follower 26, a recessed track 50 is formed in the rear wall 12 so that the first bolt engaging element 44 is able to move along the track 50 during the loading and unloading of cartridges.

The cartridge magazine also includes a ledge 52 having a ledge wall 54. The ledge 52 extends outwardly from the exterior surface of the rear wall 12, preferably a distance of about 0.13 inches. A lower ridge or window 56 also extends outwardly from the exterior surface of the rear wall 12. The lower ridge 56 extends less than about 0.105 inches from the exterior surface of the rear wall, and extends longitudinally at least 1.3 inches downward from the ledge wall 54. In this embodiment, the ledge wall 54 is generally straight and connects the bottom edge of ledge 52 with the top edge of the lower ridge 56. An upper ridge 58 projecting outwardly from the exterior surface of the rear wall 12 is additionally provided and extends longitudinally beyond the lower ridge 56.

Although the window 56 is shown as comprising an opening through the rear wall 12, the window 56 need not comprise an opening. For example, the window 56 may be a recess formed in the rear wall 12. The importance of the window 56 is that it must be of enough length and depth to permit sufficient rotation of a lever latch found on the Ruger Mini-14/AC 556 firearm so that the lever latch can be disengaged from the cartridge magazine when removing the magazine from this firearm. Without the window 56, the magazine becomes lodged in the firearm and cannot be easily removed. The length of the upper ridge 58 can also vary but should be of sufficient length to hold the magazine together and form a relatively rigid unit.

Figure 3:
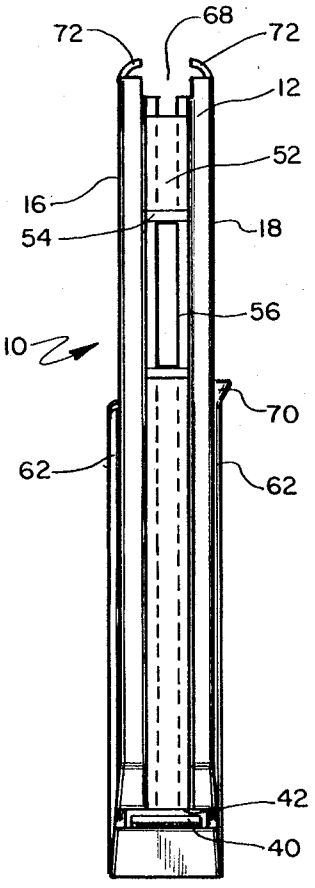
FIG. 3 is a rear elevational view thereof.
Figure 2:
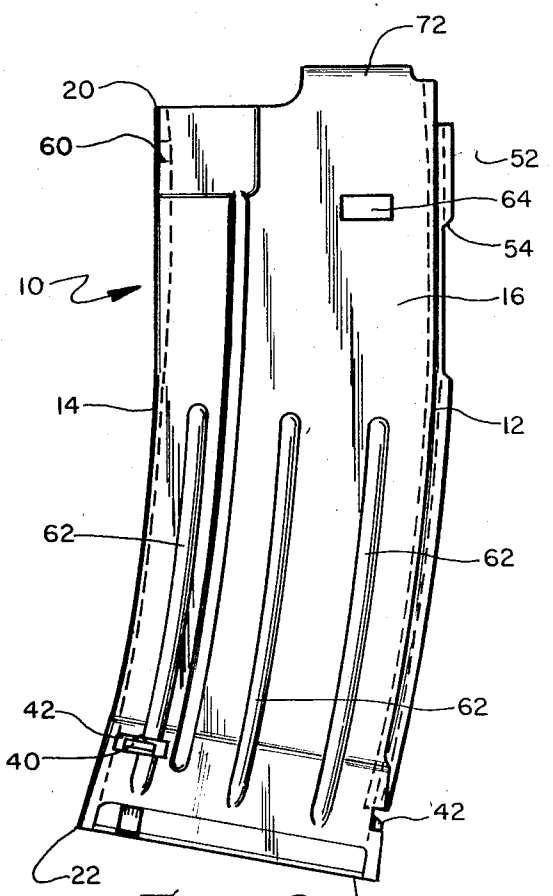
FIG. 2 is a first side elevational view thereof.

The front wall 14 has a slot 60 formed therein. The slot 60 may take the form of a recess but is preferably a hole through the front wall 14. The upper edge 20 of the front wall 14 is substantially perpendicular to both the first side wall 16 and the second side wall 18. More particularly, as best seen in FIG. 3, the exterior surfaces of the first side wall 16 and second side wall 18 are substantially straight or planar, keeping in mind the fact that the first side wall 16 and the second side wall 18 contain various projecting members such as ribs 62.

In conjunction with the discussion of further aspects of the cartridge magazine, it is useful to define a reference plane. The defined reference plane includes the upper edge 20 and is substantially perpendicular to the exterior surface of the front wall 14. This reference plane is useful in defining the position of various elements of the preferred embodiment of this invention, it being understood that each reference to a distance from the reference plane means a distance measured along a line perpendicular to the reference plane.

The combination of the ledge wall 54 and the front wall slot 60 are of such shape and position as to be capable of engaging with the latching elements or devices of one of the plurality of styles of firearms. In particular, the ledge wall 54 and the slot 60 are of such shape and position as to be capable of receiving and engaging the latching elements of the Ruger Mini-14/AC 556 style of firearm. In the preferred embodiment, the ledge wall 54 is between about 0.95–1.02 inches from the reference plane. The center of the front wall slot 60 lies substantially on the longitudinal midline of the front wall 14 about 0.28 inches from the reference plane. In one embodiment of this invention, the slot 60 is substantially circular in shape with a diameter of about 0.187 inches.

The second side wall 16 contains a slot 64 which is of such shape and position as to be capable of receiving and engaging the latching mechanism of a second of the plurality of styles of firearms. In particular, slot 64 is of such shape and position as to be capable of engaging with the cartridge magazine latching mechanism on the M16/AR-15 style of firearm. In the preferred embodiment, slot 64 is substantially rectangular in shape having dimensions of about 0.25 inches by 0.437 inches.

In the preferred embodiment also, a slot 66 is formed in the second side wall 18 of such shape and position as to be capable of receiving and engaging the cartridge magazine latching mechanism found on the AR-180 firearm. The second side wall slot 66 is preferably substantially rectangular in shape having dimensions of about 0.07 inches by 0.482 inches.

The case 10 of the present invention also has a space 68 defined at the top of the case 10 through which cartridges may be moved. Firearms to which the cartridge magazines of the present invention are adapted typically contain a cartridge moving means capable of effecting the movement of a cartridge through the space 68 when the space 68 is placed in a position adjacent to the cartridge moving means. Such firearms also typically contain a cartridge magazine well or receiving member having a lower edge. In connection with inserting the magazine into the cartridge magazine well, the cartridge magazine has a stop member 70. The stop member 70 is provided for the purpose of controlling the extent to which the cartridge magazine can be inserted into the cartridge magazine well of the firearm. Specifically, the stop member 70 controls the extent of insertion by being positioned such that the stop member 70 engages with the lower edge of the magazine well of at least one style of firearm when the cartridge magazine has been inserted a predetermined distance. Once the magazine has been inserted the predetermined distance, the space 68 of the cartridge magazine will be placed in a position adjacent to the cartridge moving means such that the cartridge moving means of the firearm is rendered capable of effecting the movement of a cartridge through the space 68. The stop member 70 comprises a projection on the exterior surface of the case 10 which is engageable with the lower edge of the magazine well. In one embodiment, the stop member 70 comprises a projection extending outwardly from the exterior surface of the case 10 about 0.15 inches and includes a wall portion that is located about 2.5 inches from the reference plane. FIGS. 1, 3, 4, and 5 show the stop member 70 projecting from the second side wall 18. As will be readily understood, the stop member 70 may be disposed on the exterior surface of any wall provided it is positioned so as to insure that, when it is engaged, the space 68 is positioned relative to the cartridge moving means in such a way that the cartridge moving means is capable of effecting the movement of a cartridge through the space 68.

As illustrated in FIG. 6, the cartridge magazine further includes lips 72 integral with and extending outwardly from the first and second side walls 16 and 18. A positioning member 74 is attached to or integrally formed on a portion of an interior surface of at least one of the lips 72. The positioning member 74 is of such shape and location as to position or guide the cartridges for loading into the firearm. The positioning member 74 engages the cartridge so that the nose end of the cartridge is properly aligned for receipt by the firearm in order to prevent jamming of the cartridge. Besides the positioning member 74 shown in FIG. 6, other positioning configurations can be employed, such as a proper tapering of the walls, to ensure that the cartridges do not become misaligned. The positioning member 74 is of particular use when the case 10 is formed of a deflectable material, such as plastic. The positioning member 74, in one embodiment, has a height of about 0.2 inches and a width of about 0.1 inches.

In order that the present invention be used in more than one style of firearm, the width of the case 10 is less than the width of cartridge magazine cases conventionally used with the M16/AR-15 style of firearm. The thickness of the case 10 is also less than the thickness of cartridge magazine cases conventionally used with the Ruger Mini-14/AC 556 style of firearm. In addition, the protrusion that is found on the conventional magazine used with the M16/AR-15 style of firearm and located immediately next to its latch-engaging slot is not found on the present invention.

The length of the case 10 can vary depending upon the maximum number of cartridges desired to be held in the case 10, i.e. the longer the case 10 the more cartridges that can be held by it. In embodiments of the invention in which about 10–40 cartridges are held in the case 10, the radius of curvature associated with the case 10 is different from that found in a conventional Ruger Mini-14/AC 556 magazine. Specifically, in forming the radius of curvature of that portion of the case 10 near the ledge 52 and the lower ridge 56, the thickness of the rear wall 12 is reduced while the thickness of the front wall 14 is increased. Such a configuration assures proper alignment of each cartridge for receipt by the firearm.

The operation of the cartridge magazine of the present invention is next discussed in connection with different firearms. Cartridges are inserted into the case 10. As cartridges are inserted, the follower 26 is forced downward in the magazine chamber 24. Typically, the chamber 24 is filled with the cartridges and the follower 26 is forced down further with the insertion of each cartridge. The cartridge magazine can then be inserted into one of the plurality of styles of firearms to which the magazine of the present invention is adapted.

Proper insertion of the cartridge magazine is made possible by the reduced dimensions of the case magazine, and specifically the changes made in the width and thickness of the case 10 in comparison with cartridge magazine cases conventionally used. In the case of the Ruger Mini-14/AC 556 firearm, insertion of the cartridge magazine into the firearm magazine well continues until a latching protrusion on this firearm engages the slot 60. After this engagement, the magazine is rotated so that a latch lever on the firearm engages the ledge wall 54. In the case of the M16/AR-15 style of firearm, insertion of the cartridge magazine continues until the latching mechanism on the firearm engages the slot 64 and also the stop member 70 engages the cartridge magazine well on the firearm. With regard to the AR-180 firearm, insertion of the cartridge magazine continues until the latching mechanism of this firearm engages the slot 66 formed on the first side wall of the cartridge magazine of the present invention. After the cartridge magazine is securely joined to the selected firearm, the space 68 will be positioned, in relation to the cartridge moving means of the firearm, such that the cartridge moving means is rendered capable of moving a cartridge through the space 68.

During operation of the firearm, the cartridge moving means of the firearm moves a cartridge through the space 68, and the spring 28 urges the follower 26 upwardly. During loading into the firearm of each of the cartridges, the positioning member 74 acts to guide or align the cartridges so that they are properly received by the firearm and jamming thereof is essentially eliminated. With respect to the cartridge directly supported on and contacting the follower 26, the end portion 32 of the spring 28 assures that this last cartridge is properly aligned for receipt into the firearm while the arrangement of the leg 34 is used to assure that sufficient force is applied to maintain good bolt hold upon pressure on the bolt lock assembly. Lastly, with regard to the M16/AR-15 style of firearm, the bolt engaging element 44 acts to hold the bolt lock assembly open while the bolt engaging element 46 acts to hold the bolt lock assembly open on the Ruger Mini 14/AC 556 style of firearm after the last cartridge has been fired, to inform the user that the last cartridge was expended from the firearm.

After use of the firearm, the cartridge magazine, may be removed from the firearm in a conventional manner. The cartridge magazine thus removed may be reloaded, and may be reinserted into the same style of firearm or inserted into another of the plurality of styles of firearms to which the cartridge magazine is adapted.

It should be understood that, although the present invention has been described for use primarily with the Ruger Mini-14/AC 556 and M16/AR-15 styles of firearms, the invention is not so limited as it can be used with other styles of firearms.

Based on the foregoing detailed discussion of the present invention, a number of salient features of the invention are easily seen. The present invention can be used with a number of styles of firearms such that the user is not required to make a selection among styles of cartridge magazines before inserting the magazine in one of the styles of firearms. Further, the user is relieved of the necessity of maintaining a stock of each of a number of different styles of cartridge magazines. The cartridge magazines are insertable into the firearm in a smooth non-binding manner, while excessive insertion is prevented. Also, jamming of cartridges is prevented by use of one or more positioning members. The magazine disclosed herein also utilizes a preferred spring arrangement to better assist in the insertion of the last cartridge into an M16/AR-15 style of firearm and to facilitate the actuation of the bolt hold open mechanism on the Ruger Mini-14/AC 556 style of firearm.

Although the present invention has been described with reference to certain embodiments, it should be appreciated that further modifications can be effected within the spirit and scope of the invention.

What is claimed is:

1. A cartridge magazine for housing cartridges and adapted for use with a plurality of styles of firearms, each of the styles of firearms having a cartridge magazine latching mechanism, said magazine comprising:

a case for storing cartridges having a first end;

said case having front, rear, first and second side walls, interior surfaces of said walls defining a magazine chamber;

ledge means on an exterior portion of said rear wall, said ledge means having a ledge wall;

a slot in said front wall, said slot in combination with said ledge means being of such shape and position as to be capable of engaging the latching mechanism of a first style of said plurality of styles of firearms;

a slot in said first side wall of such shape and position as to be capable of engaging the latching mechanism of a second style of said plurality of styles of firearms;

a follower mounted for sliding movement within said magazine chamber and adapted to contact one of the cartridges; and means for urging said follower in a direction towards said first end of said case.

2. The cartridge magazine of claim 1, further comprising:

positioning means provided on said case, said positioning means being of such shape and position to prevent at least one of the cartridges from misalignment and thereby prevent jamming of the cartridge in at least one of the firearms.

3. The cartridge magazine of claim 2, wherein:

said positioning means includes a projection extending from one of said walls and contacting a cartridge to provide the desired alignment of the cartridge.

4. The cartridge magazine of claim 1, further comprising:

a stop member provided on said case, said stop member for use in preventing movement of said case relative to at least one of the firearms.

5. The cartridge magazine of claim 1, further comprising:

a lower ridge adjacent to said ledge means;

an upper ridge adjacent to said lower ridge, said upper ridge having a greater height than said lower ridge, said lower ridge having a sufficient length to permit a portion of the latching mechanism of one of said plurality of firearms to engage said ledge wall while said upper ridge does not interfere with the operation of the latching mechanism portion.

6. The cartridge magazine of claim 1, wherein:

said first style of said plurality of styles of firearms comprises an M16/AR-15 style of firearm and wherein said second style of said plurality of firearms comprises a Ruger Mini-14/AC 556 style of firearm.

7. The cartridge magazine of claim 1, further comprising:

a slot in said second wall of such shape and position as to be capable of engaging the latching mechanism of another firearm.

8. The cartridge magazine of claim 7, wherein:

said another firearm comprises an AR-180 firearm.

9. The cartridge magazine of claim 1, wherein the first and second styles of firearms each has a bolt hold open mechanism and in which:

said follower includes first and second bolt engaging means;

said first bolt engaging means being of such a shape and position as to be capable of engaging the bolt hold open mechanism of said first style of firearm; and said second bolt engaging means being of such a shape and position as to be capable of engaging the bolt hold open mechanism of said second style of firearm.

10. The cartridge magazine of claim 1, wherein:

said means for urging includes a spring having an end portion and a leg connected to said end portion, said end portion being bent at a first predetermined angle relative to a horizontal plane through said follower to allow for desired rotation of said follower and thereby properly position a cartridge for receipt by the firearm.

11. The cartridge magazine of claim 10, wherein:

said first predetermined angle is between about 11°–13°.

12. The cartridge magazine of claim 10, wherein:

said spring includes a number of coils and said leg is connected to one of said coils, said leg forming a second predetermined angle with said one of said coils that is different from the angle between another two of said coils to provide improved bolt hold open pressure.

13. The cartridge magazine of claim 12, wherein:

said second predetermined angle is about 70°.

14. A cartridge magazine adapted for use with a plurality of firearms comprising:

a case having a chamber for storing cartridges;

a follower positioned in said case for relative movement along the longitudinal extent of said case, said follower having a first bolt hold open engaging element and a second bolt hold open engaging element different from said first bolt hold open engaging element, said first bolt hold open engaging element used with a first style of firearm and said said second bolt hold open engaging element being used with a second style of firearm; and biasing means connected to said follower for use in causing movement of said follower relative to said case.

15. A cartridge magazine adapted for use with both an M16/AR-15 style of firearm and a Ruger Mini-14/AC 556 style of firearm comprising:

a case having a chamber for storing cartridges and being defined by an outside width and thickness;

said case width being less than the width of cartridge magazines conventionally used with the M16/AR-15 style of firearm; and said case thickness being less than the thickness of cartridge magazines conventionally used with the Ruger Mini-14/AC 556 style of firearm.

16. The cartridge magazine of claim 15, wherein:

said case includes a first side wall and a slot formed in said first side wall, said slot for receiving a latching part associated with the M16/AR-15 style of firearm, all portions of said first side wall adjacent to said slot being substantially in the same plane as said first side wall.

17. A cartridge magazine for housing cartridges and adapted for use with a plurality of styles of firearms, each of said styles of firearms having a cartridge magazine latching mechanism, said magazine comprising:

a rear wall having ledge means extending from said rear wall and a recess disposed adjacent to said ledge means, said recess being of a size to engage with and disengage from a latching mechanism on one of the plurality of styles of firearms;

a first side wall having a slot formed therein, said slot for engaging a latching mechanism of another one of the plurality of styles of firearms; and follower means mounted for sliding movement and adapted to contact one of the cartridges.

18. The cartridge magazine of claim 17, wherein:

said first side wall is free of protrusions adjacent to said slot so that the magazine can be used with the plurality of styles of firearms.

19. The cartridge magazine of claim 17, further comprising:

a stop member provided on said case, said stop member being positioned to engage an outer edge of a magazine well located on at least one of the firearms.

20. The cartridge magazine of claim 17, further comprising:

positioning means provided on the magazine to assist in the alignment of cartridges during operation of at least one of the firearms.

* * * * *